US005790075A

United States Patent [19]

Inugai et al.

[11] Patent Number: 5,790,075

[45] Date of Patent: Aug. 4, 1998

[54] BEAM ANTENNA DIRECTION MEASURING METHOD, DIRECTION MEASURING DEVICE AND ANTENNA DIRECTION CONTROLLER

[75] Inventors: Kazuyuki Inugai, Koto-ku; Takashi Araki, 49-7, Koguriyamakawaai, Hirosaki, both of Japan

[73] Assignees: Software Design Ltd.; Takashi Araki, both of Japan

[21] Appl. No.: 495,756

[22] Filed: Jun. 26, 1995

[30] Foreign Application Priority Data

Sep. 9, 1994 [JP] Japan ..... 6-216436
Jan. 17, 1995 [JP] Japan ..... 7-005211

[51] Int. Cl.[6] ..... H01Q 3/00

[52] U.S. Cl. ..... 342/359; 342/431; 342/440; 342/441

[58] Field of Search ..... 342/431, 440, 342/441, 359

[56] References Cited

U.S. PATENT DOCUMENTS 3,509,569 4/1970 Boddy ..... 343/113
4,263,539 4/1981 Barton ..... 318/664
4,306,240 12/1981 Yasuda et al. ..... 343/121
5,300,935 4/1994 Yu ..... 342/355

*Primary Examiner*—Thomas H. Tarcza
*Assistant Examiner*—Dao L. Phan
*Attorney, Agent, or Firm*—Adams & Wilks

[57] ABSTRACT

In order to determine the direction of a beam antenna, at least one magnetic detection device is attached to the beam antenna for measuring at least one of the horizontal and vertical components of the geomagnetic field. Maximum and minimum geomagnetic field data values are obtained from the magnetic detection devices while rotating the beam antenna. Based on output data from the at least one magnetic detection means, one or two possible direction candidates are determined. When the output data has only one possible direction candidate it is either a maximum or minimum value. The direction of the beam antenna is determined from the two direction candidates by specifying one of the candidates depending upon whether a direction of the beam antenna is to the right or left, and determining the direction of the beam antenna from one direction candidate when the output data from the at least one magnetic detection devices corresponds to the minimum or maximum geomagnetic field data.

14 Claims, 11 Drawing Sheets

BEAM ANTENNA DIRECTION MEASURING METHOD, DIRECTION MEASURING DEVICE AND ANTENNA DIRECTION CONTROLLER

BACKGROUND OF THE INVENTION

The present invention relates to a beam antenna direction measuring method and a device for detecting the direction (azimuthal and elevation angles) of an antenna by detecting a geomagnetic field. Further, the invention relates to a beam antenna direction controller capable of turning the antenna in a predetermined direction and a controlling method thereof.

Conventionally known antenna direction (azimuthal and elevation angles) measuring methods and controllers make use of mechanical systems, wherein, for example, by utilizing the fact that resistance values are changed by a variable resistor (volume), etc., attached to the rotational part of the antenna in accordance with its rotational angle, the beam direction of the antenna is determined from the changes of the resistance values.

In a device of this type, generally the beam direction of the antenna must be predetermined by a magnetic compass, etc., and the directions of an indoor antenna controller and a rooftop antenna must be adjusted. This makes it necessary to align a bearing stylus indicating the direction of the indoor antenna controller with the direction of the rooftop antenna, and then to fix the rooftop antenna on the rotor of the antenna by bolts.

In the conventional antenna controller described above, as it is necessary to at least align the direction of the rooftop antenna beam with the bearing stylus direction of the indoor antenna controller, the following problems occur. The beam direction of the rooftop antenna must be set in the same direction as the bearing stylus of the indoor antenna controller. Thus, it is necessary to determine the beam direction of the antenna by use of a magnetic compass, etc.

In such a device, as the rotation of the antenna and that of the controller bearing stylus must be accurately aligned during manufacturing, assembling adjustment work is made complicated in the manufacturing process. Also, when the direction of the rooftop antenna beam is shifted due to strong winds, etc., it is necessary to align the direction of the rooftop antenna with the bearing stylus of the indoor antenna controller.

Further, in the conventional system, as the fact that the resistance values are changed by the variable resistor (volume), etc., attached to the rotational part of the antenna in accordance with its rotational angle, there is a problem of durability of the device, which is reduced due to frictions of the contact part, i.e., the mechanical part.

Further, because of the structural reasons described above, it is impossible for the antenna controller to rotate in the same direction several times, and thus most of the currently sold devices are allowed only one direction of rotation. When wishing to rotate the antenna direction to the right only by 10° from the current direction by means of such an antenna controller, if the current antenna is rotated in a right direction up to the limit, it must be reversely rotated to the left by 350°.

Further, in the conventional product, in the case where the beam antenna is attached to moving bodies such as a motor vehicle, a ship and the like, when the traveling direction of the moving body is changed, the direction of the beam antenna attached thereto is also changed, it is necessary to know which direction the moving body is facing in order to know the real direction of the antenna beam, and thus a very expensive device is needed and further, its data processing is very complicated.

SUMMARY OF THE INVENTION

The present invention was made against such a background and its object is to provide an antenna beam direction measuring method and a direction measuring device, wherein it is possible to detect the direction of an antenna beam based on output data from one magnetic detecting means and to improve measuring accuracy while their handling and adjustments are easy. According to the present invention, as it is possible to directly estimate the antenna direction from geomagnetic data, a simple and cheap system is provided without being influenced by changes in the direction of a moving body.

Further, the other object of the present invention is to provide an antenna direction controller and a controlling method, wherein the antenna is controlled to be easily turned in a predetermined direction even when the antenna is fixed on a ground station and thus immovable or when it is mounted on a moving body.

In order to achieve the objects described above, in the antenna direction measuring method according to the present invention, a magnetic detecting means for detecting at least one of the horizontal and vertical components of the geomagnetic field is attached to the antenna, the antenna is rotated beforehand, and thus maximum and minimum data obtained by the magnetic detecting means are stored. Then, one or two bearing candidates corresponding to output data from one magnetic detecting means are specified by operation using the maximum and minimum data and when the number of the bearing candidates is two, whether the rotational direction of the antenna is to the right or to the left is identified, whether the displacement of the output data is increasing or decreasing compared with previous data is identified and based on these identification results, either one of them is specified. The antenna direction measuring device suited for embodying the method described above is provided with a magnetic detecting means for detecting at least one of the horizontal and vertical components of the geomagnetic field attached to the antenna, a means for storing the maximum and minimum values of the outputs of the magnetic detecting means when the antenna is rotated beforehand, a means for calculating the candidate of the antenna beam direction from output data from the magnetic detecting means and the maximum and minimum values, a means for storing previous output data from the magnetic detecting means, an increase/decrease identifying means for comparing the previous output data and the newest output data from the magnetic detecting means and identifying whether the displacement of the newest output data is increasing or decreasing compared with the previous data based on the rotational direction of the antenna and an identifying means for determining the real direction based on the identification result of the increase/decrease identifying means and the newest output data.

It is preferable that a plurality of the magnetic detecting means are provided at different angles, a means is provided for selecting the magnetic detecting means having the large amount of the output data change accompanying the rotation of the antenna and the antenna beam direction is measured based on the output data from this magnetic detecting means.

When the device according to the present invention is provided with sufficient storage capacity, it is possible to reduce operations every data is fetched by storing the values of the respective magnetic detecting means, calculated angles, increase/decrease situations and rotational direction data in addition to the maximum and minimum values as table form data.

Further, the beam antenna direction controller according to the present invention is constructed by an antenna, a magnetic sensor attached to the antenna, a motor for rotating the antenna, a circuit for converting the output of the magnetic sensor into an electric signal corresponding to the direction of the antenna and outputting it, an operation processor for determining the current direction of the antenna upon receiving the output of the circuit of the magnetic sensor and outputting a control signal for setting the antenna in a predetermined direction, a control means for receiving a motor control signal output to the motor by the operation processor and a power supply for driving the motor via the control means.

Furthermore, in the antenna direction control method according to the present invention, the current antenna direction is measured by using the antenna direction measuring method or the antenna direction measuring device described above, a difference between the current antenna direction and an input predetermined antenna direction is detected and the antenna is rotated so as to reduce this difference.

Furthermore, in the antenna direction control method according to the present invention, the current antenna direction is measured by using the antenna direction measuring method or the antenna direction measuring device, the direction in which the antenna is to be turned is determined by a spherical trigonometric method from current latitude and longitude data and called stations, a difference between the current antenna direction and the determined antenna direction is detected, and the antenna is rotated so as to reduce this difference.

Two azimuthal angles which are made candidates for the antenna direction are extracted from the result of calculating the output value of one magnetic detecting means and the maximum and minimum values when the antenna is rotated beforehand excluding the peculiar points of the maximum and minimum values. Then, the rotational direction of the antenna, that is, whether it is right or left, is identified, the output values previously obtained from the magnetic detecting means and the newest output value are compared, whether it is increasing or decreasing is identified, and thus the right one of the two direction candidates extracted above is selected.

Further, in accordance with the angle of the antenna beam direction to the geomagnetic field, the measuring accuracy of the magnetic detecting means is also changed and the accuracy is further worsened in the vicinities of the maximum and minimum values. Therefore, when a plurality of the magnetic detecting means are provided, the magnetic detecting means having high measuring accuracy is decided from the maximum and minimum values of the respective magnetic detecting means obtained when the antenna is rotated beforehand and a direction measuring with high accuracy is carried out by processing the output value of the decided magnetic detecting means in the above manner. Or, when a plurality of the magnetic detecting means are disposed at different angles in order to prevent worsening of the measuring accuracy in the vicinities of the maximum and minimum values and the output of one magnetic detecting means is near the maximum or the minimum value, the direction measuring is carried out by executing the above processing using the outputs of the other magnetic detecting means.

DETAILED DESCRIPTION OF THE PREFERRED EMBODIMENTS

The preferred embodiments of the antenna direction (azimuthal and elevation angles) measuring method, the measuring device and the direction controller according to the present invention will be described with reference to the drawings. The same principle applies to the measuring of the azimuthal and elevation angles and in the case of the azimuthal angle, the horizontal component of the geomagnetic field is used while a composite vector of the vertical and horizontal components thereof is used in the case of the elevation angle. Thus, the method for estimating the azimuthal angle paying attention to the horizontal component of the geomagnetic field will be described in order to simplify explanations.

First, with reference to FIGS. 1 and 2, basic concept, principle and construction of the present invention will be described. As shown in the Figures, a magnetic sensor 10 is provided in the beam direction of an antenna M. According to this embodiment, this magnetic sensor 10 is provided with one pick up coil 11 which is arranged with its winding direction in parallel to the beam direction of the antenna M. Then, the geomagnetic field is detected by this pick up coil 11 and its output value is changed by the direction thereof relative to the geomagnetic field, that is, by the direction of the antenna M.

Figures 1A, 1B:
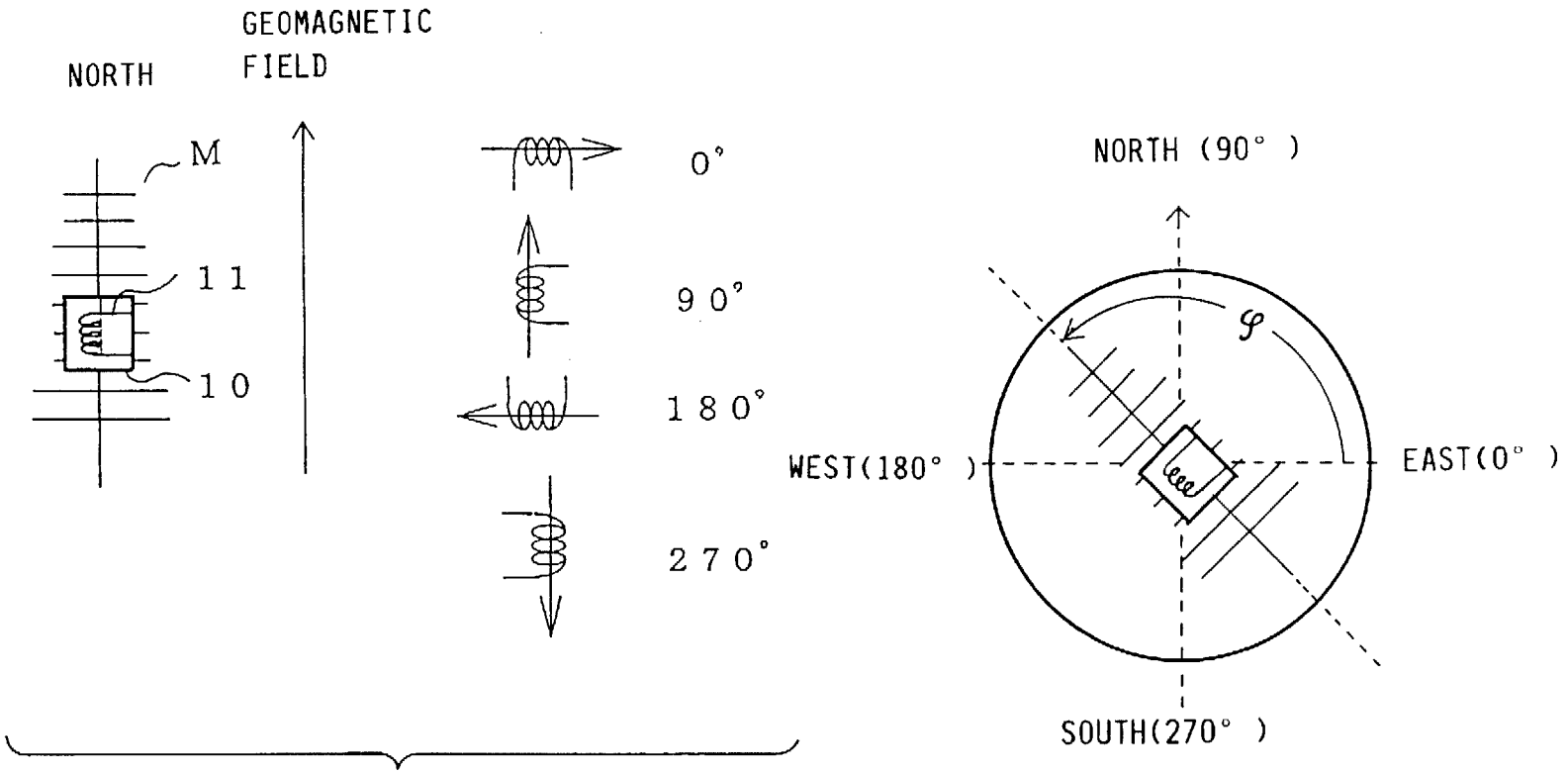
FIG. 1A is a view illustrating the positions of the antenna and the pick up coil relating to the antenna direction detection according to the present invention.
FIG. 1B is a view illustrating the relation between the antenna and the azimuthal angle relating to the antenna direction detection according to the present invention.
Figure 2:
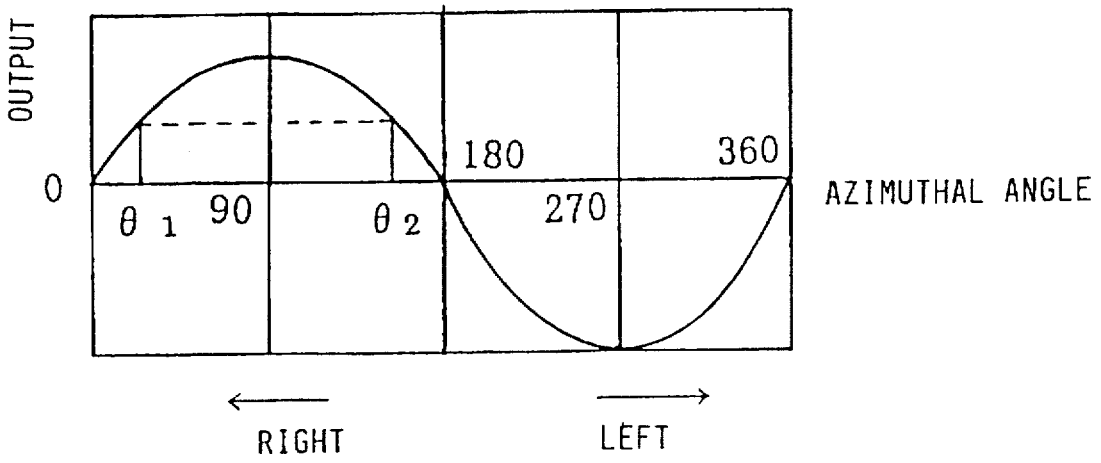
FIG. 2 is a graph showing the relation between the output value data of the circuit of magnetic sensor and the azimuthal angle relating to the antenna direction measuring device according to the present invention.

As shown in FIG. 1B, a virtual circle is drawn and in the Figure the 0° position is east, the 90° position is north, the 180° position is west and the 270° position is south respectively. Then, the output of the pick up coil 11 is as follows when the antenna M is rotated counter-clockwise on the virtual circle:

First, when the direction of the pick up coil is at the 0° position (located in the East), the antenna M is also in the east direction, the direction of the pick up coil and that of the geomagnetic field are orthogonal, and thus the output of the magnetic sensor is 0. Then, when the direction of the pick up coil comes to 90° (North) accompanying the rotation of the antenna M, the direction of the pick up coil 11 and that of the geomagnetic field are aligned, and thus its output is made maximum. Similarly, the output is 0 at the position of 180° (West) and it is a minimum value at the position of 270° (South). As shown in FIG. 2, the changes of outputs among these positions are represented as a sine curve.

Thus, by detecting the output value mentioned above, an azimuthal angle θ, i.e., the beam direction of the antenna M, may be determined. As is clear from FIG. 2, however, when a certain output value is detected, two azimuthal angles θ1, θ2 corresponding to the output value exist excluding the peculiar points of the maximum and minimum values, and it is difficult in this condition to determine on what position the antenna M is rotating. Therefore, according to the present invention, based on the fact that the two azimuthal angles θ1 and θ2 exist on both sides between the maximum and minimum values, whether the output value of the magnetic sensor 10 is increasing or decreasing is detected and either one of the angles is decided. That is, as shown in the FIG. 2, for example, if the antenna is rotated left, when the output value is increasing, the antenna M is positioned on the azimuthal angle θ1 and when it is decreasing, it is positioned on the angle θ2. Then, detection of the increase/decrease directions may be easily carried out by, for example, storing the immediatlely preceding output value and calculating a difference between the preceding data and the current output value. In this way, based on the output from one pick up coil 11 the beam direction of the antenna M may be detected.

According to this description, the pick up coil is disposed with its direction in parallel to the beam direction of the antenna. However, it is also possible to arrange it with its direction orthogonal to the beam direction of the antenna or at an optional angle. In this case, the phase of the sine curve in FIG. 2 is shifted 90° when the direction of the pick up coil and the beam direction of the antenna are orthogonal, and only its angle is shifted when it is disposed at an optional angle. This applies to the following embodiments.

EMBODIMENT 1

Figure 3:
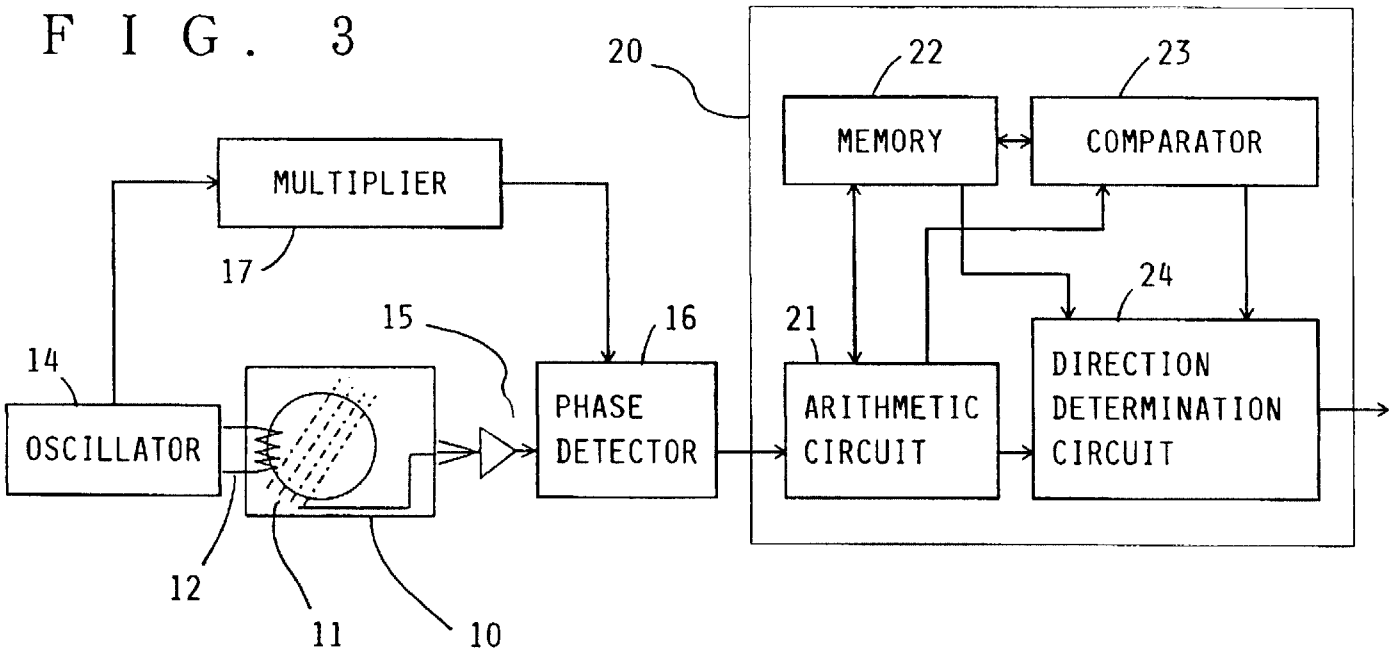
FIG. 3 is a block diagram showing the embodiment of the antenna direction measuring device according to the present invention.

FIG. 3 shows the first embodiment of the measuring device in order to carry out the measuring method described above. In this embodiment, one of the pick up coils is utilized. As shown in the Figure, the magnetic sensor 10 for detecting the horizontal components of the geomagnetic field is provided with one pick up coil 11 and a driving coil 12 for exciting this pick up coil 11. Then, to this driving coil 12 the oscillation output of an oscillator 14 for generating an AC signal of frequency f is supplied.

The detected output of the pick up coil 11 is input to a phase detector 16 via an amplifier 15. To the phase detector 16 the output signal of the multiplier 17 for multiplying the oscillated output of the oscillator 14 and converting it into the AC signal of frequency 2f is input, the phase of the detected output of the magnetic sensor 10 input from the amplifier 15 is detected at the phase detector 16 based on the output signal of this multiplier 17 and the output signal is input to a control circuit 20. The magnetic detecting means is constructed by the pick up coil 11, the driving coil 12, the oscillator 14, the amplifier 15, the phase detector 16 and the multiplier 17.

The control circuit 20 is provided with an arithmetic circuit 21 for calculating the azimuthal angle of a moving body based on a signal given by the phase detector 16 and maximum and minimum data from a memory 22, the memory 22 for storing output data from the arithmetic circuit 21, a comparator 23 for comparing differences in sizes between the data previously stored in the memory 22 and the latest data output from the arithmetic circuit 21 and a direction determination circuit 24 for identifying the beam direction of the antenna based on the output of the comparator 23 and the output data from the arithmetic circuit 21. Herein, the azimuthal angle θ of the beam direction of the antenna M measured by using a line expanded from the pick up coil 11 thereof in the east direction on geomagnetism as a reference line may be obtained by the following equation when the maximum value of the data gained at the time of one rotation beforehand is Lmax, the minimum value Lmin and the output value of the pick up coil at the time of measuring is L:

$$\theta=\sin^{-1}\{\{2L-(Lmax+Lmin)\}/(Lmax-Lmin)\} \quad (1)$$

It is preferable that the previous data is rotated once (exceeding 360° ). However, if sufficient data accuracy and data analysis are obtained, it is possible to calculate the maximum and minimum values by the above equation even at the minimum half rotation (180° ).

At the arithmetic circuit 21, output values sent from the phase detector 16 are converted to digital form by an A/D converter. For example, when an A/D converter of 8 bit resolution is provided, the output level of the phase detector 16 when the azimuthal angle θ to become the maximum value is 90° is +127 while the output level when the minimum value θ is 270° is −128. Then, based on this converted output value data, the azimuthal angle corresponding to the output value data may be calculated. The output value data and the azimuthal angle θ when necessary will be sent to specified spots.

The memory 22 is provided with a direction reference data part for storing the maximum and minimum value data obtained beforehand and the relation between the azimuthal angle θ gained from both of these values and output value data and the real direction and a previous-time data storage part for storing the output value data of the previous time determined by the arithmetic circuit 21.

At the comparator 23, the latest output data determined by the arithmetic circuit 21 and the immediately preceding output value data stored in the previous-time data storage part of the memory 22 are compared, whether they are the same or not is determined, a difference signal is produced when they are different, whether the latest output data is on the increase or on the decrease is identified based on the data of the rotational direction of the antenna and this identification result is sent to the direction determination circuit 24. The memory 22 is further provided with a buffer memory for temporarily storing the latest output value data and the above processing is carried out based on the latest output value data stored therein. After the above identification, the latest output value data stored in the buffer memory will be sent to the previous-time data storage part of the memory 22 when necessary and it will be made ready for next comparison.

At the direction determination circuit 24, the azimuthal angle θ of the current beam of the antenna M is determined based on the latest azimuthal angle data sent from the arithmetic circuit 21, the direction reference data for the azimuthal angle sent from the memory 22 and the identifying signal sent from the comparator 23. Herein, the direction reference data is for correcting, for example, a difference between the north indicated by the geomagnetic field, i.e., the one indicated by the pick up coil, and the North Pole.

One embodiment of the azimuthal angle measuring method using the device described above will be explained. First, before the azimuthal angle is measured, calibration must be carried out in order to determine output value data to be stored in the maximum and minimum value data part of the memory 22.

Figure 4:
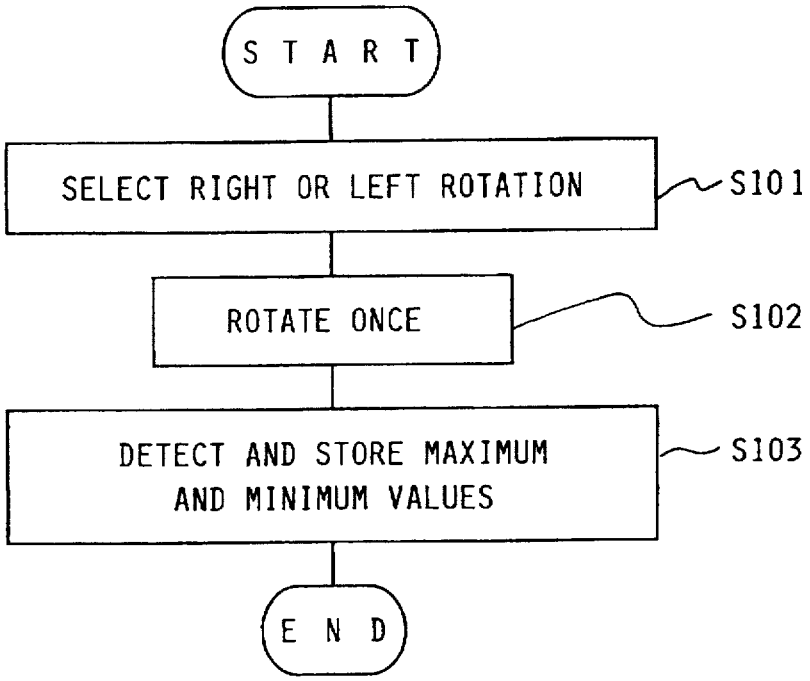
FIG. 4 is a flow chart illustrating the antenna direction detecting method according to the present invention.

As shown in FIG. 4, first the right or the left rotation of the antenna M is selected (S101). As for this selection, a manual method by providing selection switches or an automatic method by a microcomputer is available.

Then, the antenna must be rotated in the selected direction (e.g., in the left direction) at least once. As this rotational movement is only for gaining maximum and minimum values, it is not necessary to rotate it at a specified speed but an optional speed may be selected (S102). At the arithmetic circuit 21, the output value data which are obtained at the time of rotation and which continuously changes is detected, its positive maximum value is made the maximum value while the negative maximum value is made the minimum value and these values are stored in the maximum and minimum value data part of the memory 22 (S103). As for calculation of the azimuthal angle θ, as described above referring to the equation (1), when the antenna is rotated left at the time of calibration, the maximum value is 90°, the minimum value 270°, 0° at the time of a zero output changing from negative to positive, 180° at the time of a zero output changing from positive to negative, the angle θ is easily gained by comparing them with the direction reference data, and thus it is preferred that for direction measuring which will be described below this calibration is finished and the output value data at the time of the rotational stop of the antenna M is stored in the previous-time data storage part of the memory 22 as an initial value.

Figure 5:
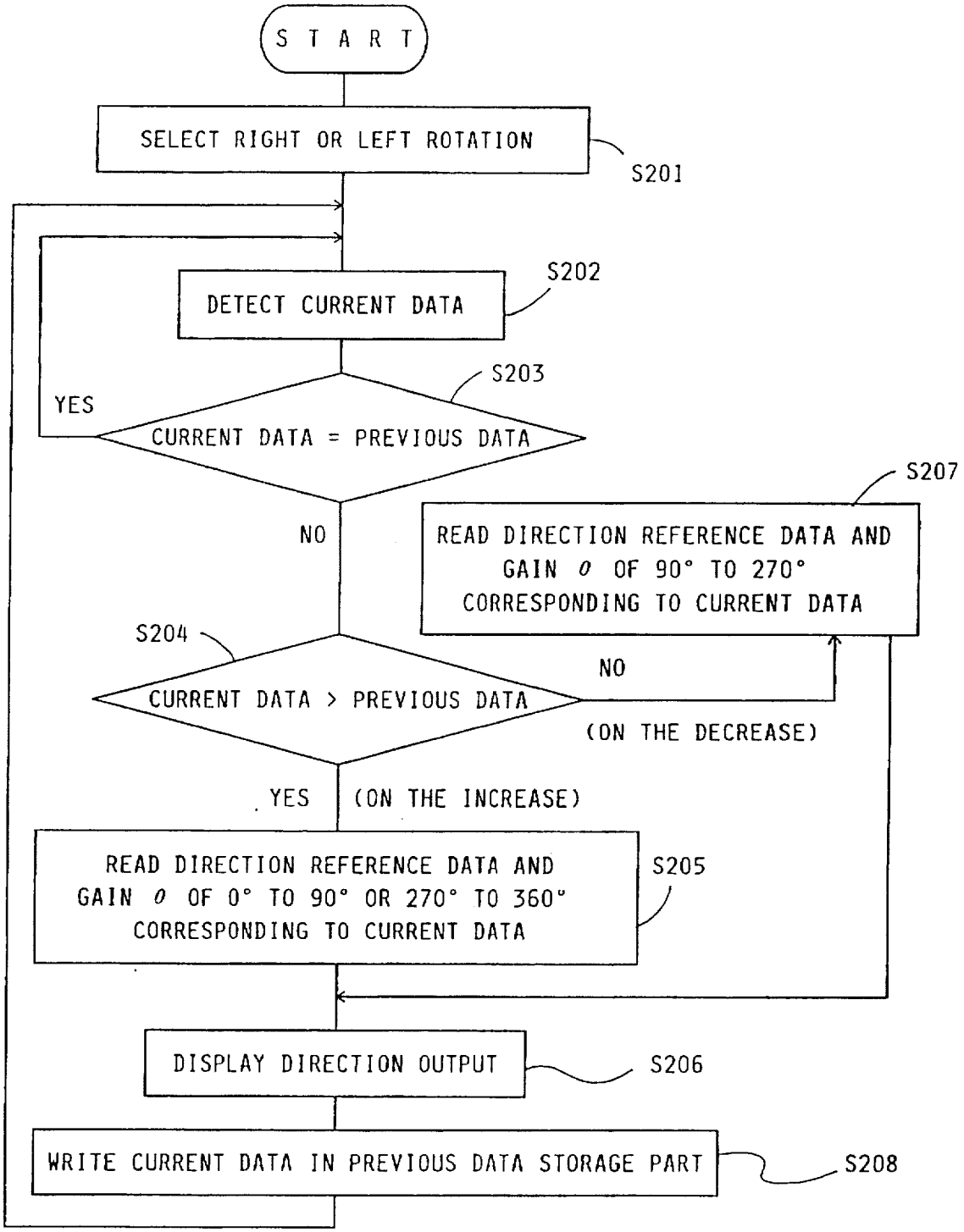
FIG. 5 is a flow chart illustrating the antenna direction detecting method according to the present invention.

When the maximum and minimum values of the output value data are gained in this way, real direction measuring will be operated. As shown in FIG. 5, first the right or the left rotation is selected (the description below is based on the assumption that the left rotation is selected) and the latest output value data (present data) will be calculated (S201, 202).

Then, whether the output value data and the previous output data value (previous data) stored in the memory 22 are equal or not is identified at the comparator 23 and, since it means that the antenna M has not rotated from the time when the previous output value data was detected when they are equal, the latest output value data must be gained again by returning to the step S202. On the other hand, as it means that the antenna has rotated when they are different, a next step (S203) will be carried out.

By calculating a difference between both data, whether the current data is larger than the previous data is identified (S204). When it is larger, as it means that it is on the increase, the direction reference data will be read, the one of the azimuthal angles corresponding to the current data within the range of 0° to 90° or 270° to 360° will be identified to be the current azimuthal angle θ, and it will be output and displayed (S205, 206).

Further, when it is smaller, as it means that it is on the decrease, the direction reference data will be read, the one of the azimuthal angles corresponding to the current data within the range of 90° to 270° will be identified to be the current azimuthal angle θ and based on this the direction of the antenna M will be output and displayed (S207, 206). Then, the current data stored in the buffer memory of the comparator 23 will be written in the previous data storage part of the memory 22 (S208). Thereafter, by repeating the above processes, the latest beam direction of the antenna M may be measured and displayed.

Furthermore, by providing a latch, etc., at the time of display, as long as no new data about the azimuthal angle θ is input, the current direction of the antenna M will be displayed even when both data are equal at the step S203 and the direction identification processes after the step S204 are not carried out if the previous value is held (display). Also, when the antenna M is rotated right, as the directions of increase/decrease are made reverse to the above case, identifications at the respective steps must be made reverse. Thus, it is needless to say that data on the rotational direction of the antenna will be necessary in order to determine the azimuthal angle thereof.

EMBODIMENT 2

Figure 6:
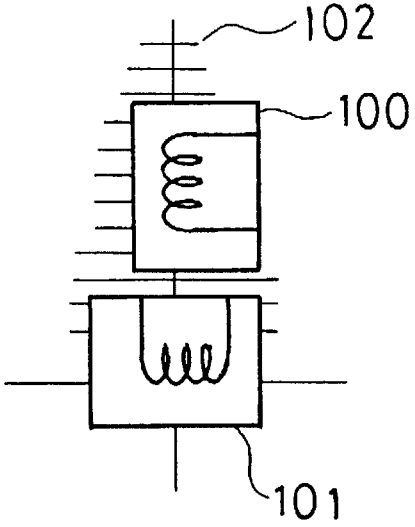
FIG. 6 is a view illustrating the embodiment of the antenna direction detection using two pick up coils according to the present invention.
Figure 7:
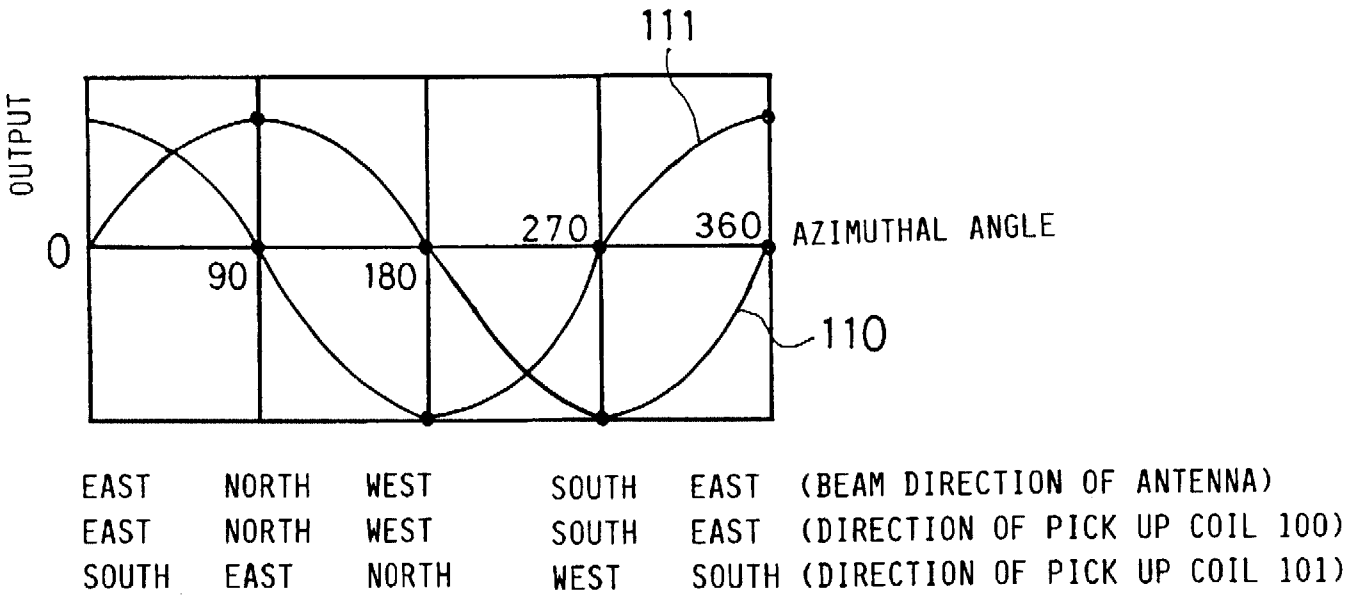
FIG. 7 is a graph showing the relation between the output value data of the respective pick up coils and the azimuthal angle in FIG. 6.

The case where a plurality of pick up coils are provided will be described. FIG. 6 shows an embodiment, wherein two pick up coils are provided. One is a pick up coil 100 disposed in parallel to the beam direction of an antenna 102 while the other is a pick up coil 101 disposed orthogonally to the beam direction of the antenna 102. Then, depending on the direction of the antenna 102, the output value 110 in FIG. 7 is taken by the pick up coil 100 while the output value 111 in FIG. 7 is taken by the pick up coil 101. That is, when the antenna 102 faces north, the maximum value is indicated by the pick up coil 100, when it faces west, the minimum value is indicated by the pick up coil 101, when it faces south, the minimum value is indicated by the pick up coil 100 and when it faces east, the maximum value is indicated by the pick up coil 101.

In the case where two pick up coils are used as this embodiment, the following advantages will be obtained:

When the antenna 102 faces the vicinity of the north or the south, a value in the vicinity of the maximum or minimum value is taken by the pick up coil 100 as its output. If the direction of the antenna is identified based on the output value of the pick up coil 100, in such a case, as clear from FIG. 7, detecting accuracy will get worse. However, if the output of the pick up coil 101 is used in such a case, as the amount of changes of the output value is larger than that of the angle, the direction of the antenna 102 may be accurately detected. Similarly, when the antenna faces the vicinity of the west or the east, if the output value of the pick up coil 100 is used, the direction of the antenna 102 may be detected.

Or, if the output value of the pick up coil indicating the larger maximum value (or the smaller minimum value) of the maximum and minimum values of the output values of the respective pick up coils is used, the direction of the antenna 102 may be accurately detected.

In this embodiment, similarly to the first embodiment, two azimuthal angles exist for one output value of the pick up coil excluding the cases of the maximum and minimum values. However, as in the first embodiment again, one of them may be selected by identifying whether the output value is on the increase or on the decrease based on the rotational direction of the antenna.

Based on the use of two pick up coils orthogonally disposed, when the output value of the pick up coil 100 is on the increase, a positive value will be taken for the output value of the pick up coil 101, and when it is on the decrease, one azimuthal angle may be determined by utilizing the fact that a negative value will be taken for the output value of the pick up coil 101.

For the measuring device according to this embodiment for detecting the beam direction of the antenna using two pick up coils, the one shown in FIG. 3 may be used. This embodiment is different from the first in that two output values of the pick up coils 100 and 101 are output from the phase detector 16. Of course, the output value of the pick up coil is obtained by the same operation as in the case of the first embodiment. However, whether two amplifiers 15 and two phase detectors 16 may be used in order to provide two output values simultaneously or a switching circuit is provided in order to provide output values time-divisionally and serially may be freely selected.

The case where the output values of the pick up coils 100 and 101 will be described.

Before the azimuthal angle of the antenna 102 is detected, the maximum and minimum values of the output of the pick up coils 100 and 101 will be obtained respectively by rotating the antenna 102 once beforehand. At the arithmetic circuit 21, two output values sent from the phase detectors 16 are successively converted into digital signals by two A/D converters. By the arithmetic circuit 21 the maximum and minimum values of the output of the pick up coils 100 and 101 will be gained from these digital signals obtained during one rotation of the antenna 102 and stored in the memory 22.

Then, the azimuthal angle of the antenna 102 will be detected. The output values of the pick up coils 100 and 101 gained from the current direction of the antenna 102 will be outputted from the phase detectors and A/D converted by the arithmetic circuit 21. The angle θ of the pick up coil 100 is gained by the equation (1) while the angle ø of the pick up coil 101 is given at θ0 −90°. At this time, as described above, whether the antenna 102 faces the vicinity of the north or the south is detected from the output value of the pick up coil by the arithmetic circuit 21, and in such a case the angle θ may be accurately obtained using the output value of the pick up coil 101. The operational result of the equation (1) may be obtained by preparing a hardware exclusive for the arithmetic circuit 21 or by software processing of a microcomputer.

As a candidate for θ corresponding to the output value of the pick up coil, two angles excluding peculiar points will be obtained. At the control circuit 20, by executing the same operation as in the case of the first embodiment, a right azimuthal angle will be obtained. That is, the latest output data given by the arithmetic circuit 21 and the previous output value data stored in the previous data storage part of the memory 22 will be compared by the comparator 23. Whether they are the same or not will be identified, a difference therebetween will be calculated when they are different, whether the latest output data is on the increase or on the decrease will be identified based on the rotational direction of the antenna and the result of this identification will be sent to the direction determination circuit 24. The latest output value of the pick up coils 100 and 101 stored in the buffer memory of the comparator 23 will be sent to the previous data storage part of the memory 22 when necessary and made ready for next comparison.

At the direction determination circuit 24, the current beam azimuthal angle of the antenna 102 is determined on the basis of the latest azimuthal angle data sent from the arithmetic circuit 21, the direction reference data to an azimuthal angle signal sent from the memory 22 and an identifying signal sent from the comparator 23.

Selection of one of the two azimuthal angle candidates may be carried out as well, based on identification whether the output value of the pick up coil 101 is positive or negative other than the way mentioned in the first embodiment. In this case, the control circuit 20 will be further simplified and a hardware or a software will be provided with the operational function of the equation (1), the positive/negative identifying function of the pick up coil and an azimuthal angle deciding function for determining which candidate to be selected based on the identification result thereof.

Further, the present invention may be applied to the case where two pick up coils are not arranged orthogonally. For example, the pick up coil 100 is disposed in parallel to the beam direction of the antenna 102 while the pick up coil 101 is disposed at an angle η to the coil 100. In this case, the output of the pick up coil 101 at the time of calibration is made to a sine waveform having a phase angle η against that of the coil 100 at the time of calibration. This phase angle η may be gained from the output value of the pick up coil 100 when zero, a maximum value or a minimum value is output by the coil 101 at the time of calibration. For example, a difference between an angle gained from the output value of the pick up coil 100 when the maximum value is output by the coil 101 and an angle 90° when the maximum value is output by the coil 100 will become this phase angle η. Thus, when a value in the vicinity of the maximum or the minimum value is taken by the pick up coil 100, the output value of the pick up coil 101 may be used in order to obtain the antenna direction more accurately and the phase angle η will be corrected based on this result. Other operations are the same as described above.

This embodiment is advantageous in that if the pick up coil 100 is arranged in parallel to the beam direction of the antenna, the pick up coil 101 may be arranged at an operational angle to the coil 100 and manufacturing of the antenna direction controller will be made easier.

EMBODIMENT 3

The embodiment of the beam antenna direction controller using the beam antenna direction measuring method and the direction measuring device shown in the embodiments 1 and 2 will be described with reference to FIG. 8.

The beam antenna direction controller of this embodiment is constructed by an antenna 102, a magnetic sensor 120 including a pick up coil attached to the antenna 102, a motor 128 for rotating the antenna 102, a magnetic sensor circuit 121 constituted of an electronic circuit part, etc., of a flux gate magnetometer for converting the output of the magnetic sensor 120 into an electric signal corresponding to the direction of the antenna 102 and outputting it, an A/D converter 122 for converting the output of the circuit of magnetic sensor 121 into a digital signal, an interface 123 for sending the output of the A/D converter 122 to a next stage as data for determining the direction, a processor 124 for determining the current beam direction of the antenna 102 upon receiving the output 132 of the interface 123 and outputting a control signal for setting the antenna 102 in a specified direction, a semiconductor relay 126 for receiving a motor control signal 133 for a motor 128 output from the processor 124 via the interface 123 and a photocoupler 125 and a motor power source 127 which is an AC power supply for driving the motor 128. The processor 124 is constituted of a personal computer, etc., and in this case, such peripheral devices as a display device 129 of a CRT, etc., a keyboard 131, a storage device 130 of a floppy drive and a hard disk drive and the like are connected to it.

The current beam direction of the antenna 102 is detected by the same operation as in the cases of the embodiments 1 and 2. That is, the data of the azimuthal angle Q of the antenna beam detected by the magnetic sensor 120 is converted into an electric signal by the magnetic sensor circuit 121 and output, it is converted into a digital signal by the A/D converter 122 and made to direction determining data, and input to the processor 124 via the interface 123. Here, the output of the magnetic sensor circuit 121 is equivalent to the output of the phase detector 16 in FIG. 3. At the processor 124, the azimuthal angle Q of the current beam of the antenna 102 is decided from the direction deciding data by a circuit similar to the control circuit 20 in FIG. 3 or by the same method as in FIGS. 4 and 5. This obtained azimuthal angle Q of the current antenna beam is stored in the other storage part of the processor 124.

When the antenna 102 is turned in a predetermined direction, a predetermined azimuthal angle P is input from the keyboard 131. At the processor 124, the input azimuthal angle P and the current antenna azimuthal angle Q are compared and the motor control signal 133 is output so as to eliminate the difference therebetween.

In the case of this embodiment, switching ON and OFF of the semiconductor relay 126 is controlled by the motor control signal and application of the current of the motor power 127 to the motor 128 is controlled. In this way, the antenna 102 is rotated, the azimuthal angles $Q_1$ of the antenna 102 during rotation are successively gained at the processor 124, they are compared with the predetermined azimuthal angle P and a new motor control signal 133 is output. Then, when the difference between the predetermined azimuthal angle P and the current azimuthal angle Q is eliminated or when this difference is reduced more than specified, the motor is stopped. Of course, depending on the kinds of motors, the motor control signal 133 output from the processor 124 changes. For example, in the case of the motor whose rotation is controlled by the pulse counts or the pulse widths of the motor driving signal, it is necessary to give only once pulse counts and pulse widths corresponding to a rotational angle decided by the difference between the predetermined azimuthal angle P and the current azimuthal angel Q of the antenna 102 as the motor control signal 133. Also, at the processor 124 according to this embodiment, whether the difference between the predetermined azimuthal angle P and the current azimuthal angle Q is positive or negative is identified and whether the antenna 102 must be rotated right or left is determined.

A method for setting and controlling the antenna in a predetermined azimuthal angle will be described.

Figure 9:
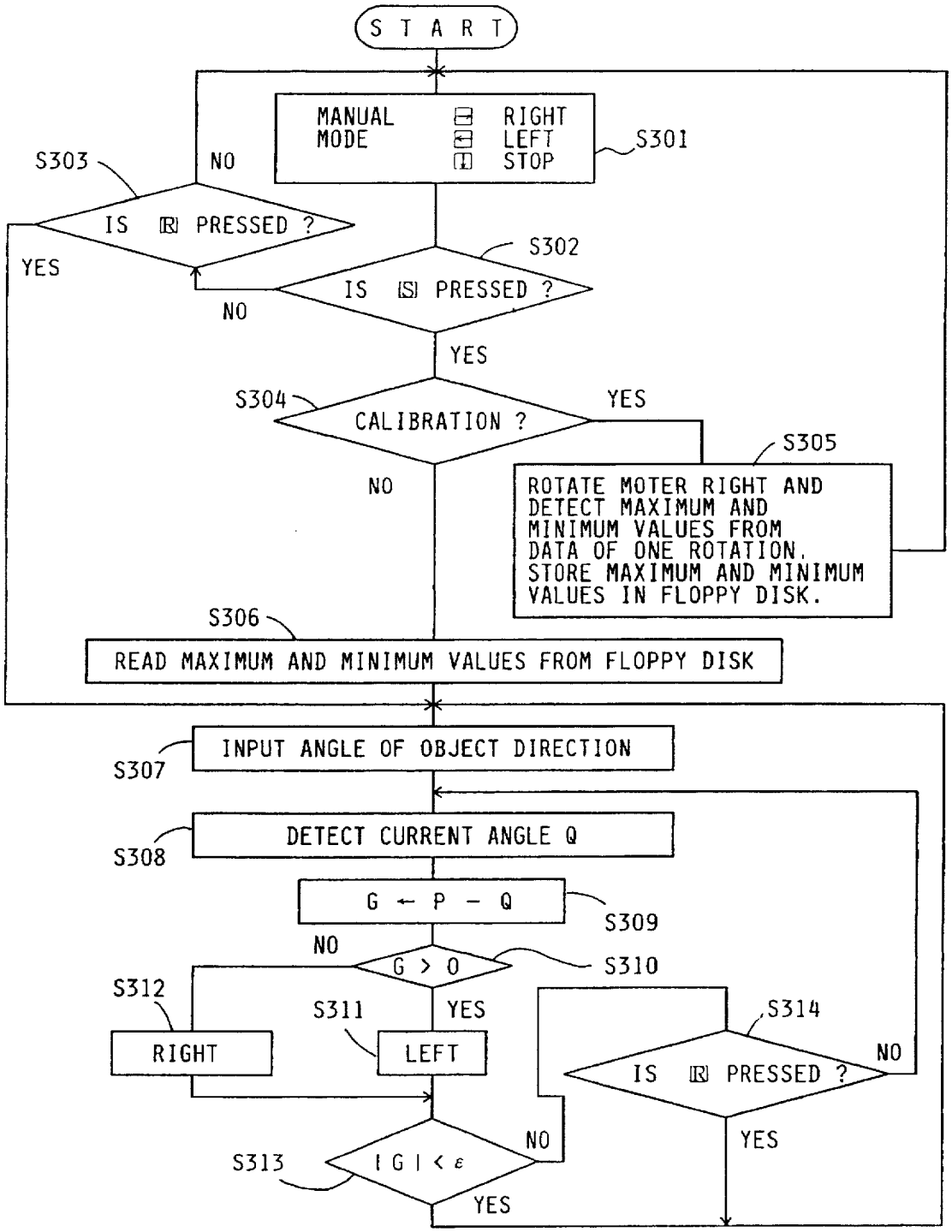
FIG. 9 is a flow chart illustrating the beam antenna control method according to the present invention.

FIG. 9 is a flow chart showing one embodiment of this method. First, the motor, that is, the antenna, must be set to be rotated right or left and stop on a manual mode. This may be set by the keyboard of a personal computer, wherein ⌈→⌋ means right, ⌈←⌋ means left and ⌈↓⌋ means stop (S301). Then, whether the operation is started or not is detected (S302). For example, pressing of the key ⌈S⌋ is identified and when it is pressed, whether the maximum and minimum values of the outputs (values corresponding to the azimuthal angle of the antenna) of the magnetic sensor at the time of calibration, i.e., at the time of one rotation of the antenna, must be detected or not is identified (S304). When ⌈S⌋ is not pressed, whether going to a step for inputting the azimuthal angle P of the target direction or not is identified. For example, when the key ⌈R⌋ is pressed, the operation goes to a step for inputting the azimuthal angle P of the target direction, and when neither ⌈S⌋ nor ⌈R⌋ are pressed, it returns to the first step (S303). When calibration is carried out, the motor, i.e., the antenna, is rotated, for example, right, its maximum and minimum values are detected from the output data of the magnetic sensor equivalent to one rotation and stored in a floppy disk, a hard disk, or other storage means of RAM, etc. (S305). After that it returns to the first step. When no calibration is carried out, the maximum and minimum values are read from the storage means (S306).

Then, the azimuthal angle P in which the antenna is to be turned is input from the keyboard (S307). Then, the azimuthal angle Q which the antenna is currently facing is detected (S308). For this, the method or the device described in the embodiments 1 and 2 are used. In order to compare the predetermined azimuthal angle P and the current angle Q, G=P−Q is calculated (S309). Whether G is positive or not is identified (S310). Here, as the azimuthal angle indicates an angle at the time of anti-clockwise rotation (left) with east as reference O, the motor, i.e., the antenna, is rotated left when G is positive (S311), and it is rotated right when G is not positive (S312). Whether the absolute value of G is within the set range or not is identified (S313), when it is larger than a reference value, pressing of ⌈R⌋ is identified (S314) and then the operation returns to the previous step. When ⌈R⌋ is pressed, the operation returns to the step S307 while it returns to the step S308 when ⌈R⌋ is not pressed and the operations are repeated from the step S308 to S314 until the absolute value of G comes within the range.

According to the method of this embodiment, the motor, i.e., the antenna, is rotated, the directions of the antenna are successively detected during the rotation thereof, differences between the antenna directions and the predetermined directions at this time are successively calculated and the direction of the antenna is controlled so as to eliminate the difference therebetween. However, it is also possible to set the motor, or the antenna, in the predetermined direction by one controlling based on the value of G initially obtained.

Further, so as to quickly turn the antenna in the predetermined direction, it is possible to control the right and left rotations of the motor, or the antenna, by changing the identifying conditions of the step S310. Also, it is possible to set the identifying operation of the step S313 between the steps S309 and S310.

EMBODIMENT 4

At the embodiment 3, the direction in which the antenna is to be turned is represented by the azimuthal angle on a plane. This system is good as long as a called party is within a relatively short distance. However, the effect of the fact that the Earth is spherical begins to appear if it is on a far place. In such a case, it is known that spherical trigonometric method is good. One embodiment of the antenna device and the antenna controlling method using spherical trigonometric method will be described with reference to FIGS. 10 and 11.

Figure 10:
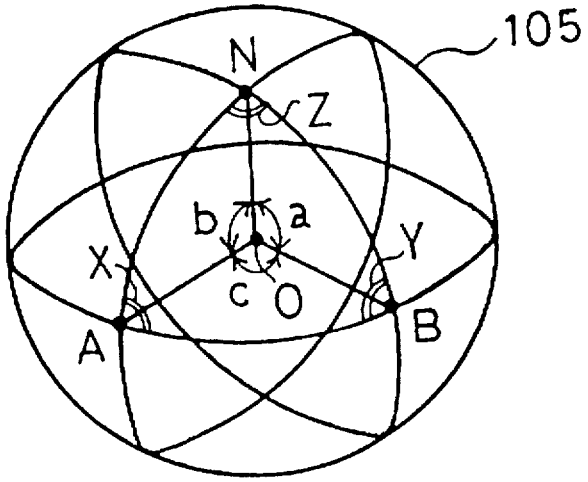
FIG. 10 is a view illustrating spherical trigonometric method relating to the beam antenna control method according to the present invention.

Herein, angles are expressed in degrees. It is needless to say, however, that radian may be used with proper changes. In FIG. 10, the Earth 105 is sphere, its center is O, the present station thereon is A, the called party is B, the North Pole is N, an angle between a line connecting N and A and that connecting A and B is X, an angle between a line connecting N and B and that connecting A and B is Y, an angle between a line connecting N and A and that connecting N and B is Z, an angle between N and B against the center O is a, an angle between N and A against the center O is b and an angle between A and B against the center O is c. In this case, the following expression is obtained:

$$\sin a/\sin X=\sin b/\sin Y=\sin c/\sin Z \quad (2)$$

Thus, when with a line between N and A as a reference 0° an angle in a right direction is taken, the azimuthal angle X from the present station A to the called party B is represented by the following expression:

$$X=\sin^{-1}(\sin a\cdot\sin Z/\sin c) \quad (3)$$

(where, $-90°<X<90°$)

A distance L between A and B on the globe surface is represented by the following expression:

$$L=2\pi rc/360(r\text{:radius of the Earth}) \quad (4)$$

Herein, when the positions (latitude and longitude) of A and B on the Earth are represented by (α, β) and (γ, δ), the expressions are obtained:

$$c=\cos^{-1}(\cos a\cdot\cos b+\sin a\cdot\sin b\cdot\cos Z)\ a=90-,\ b=90-,\ Z=ABS(\beta-\delta) \quad (5)$$

(ABS indicate absolute values)

By these expressions, the predetermined azimuthal angle X and the distance L are obtained.

Figure 11:
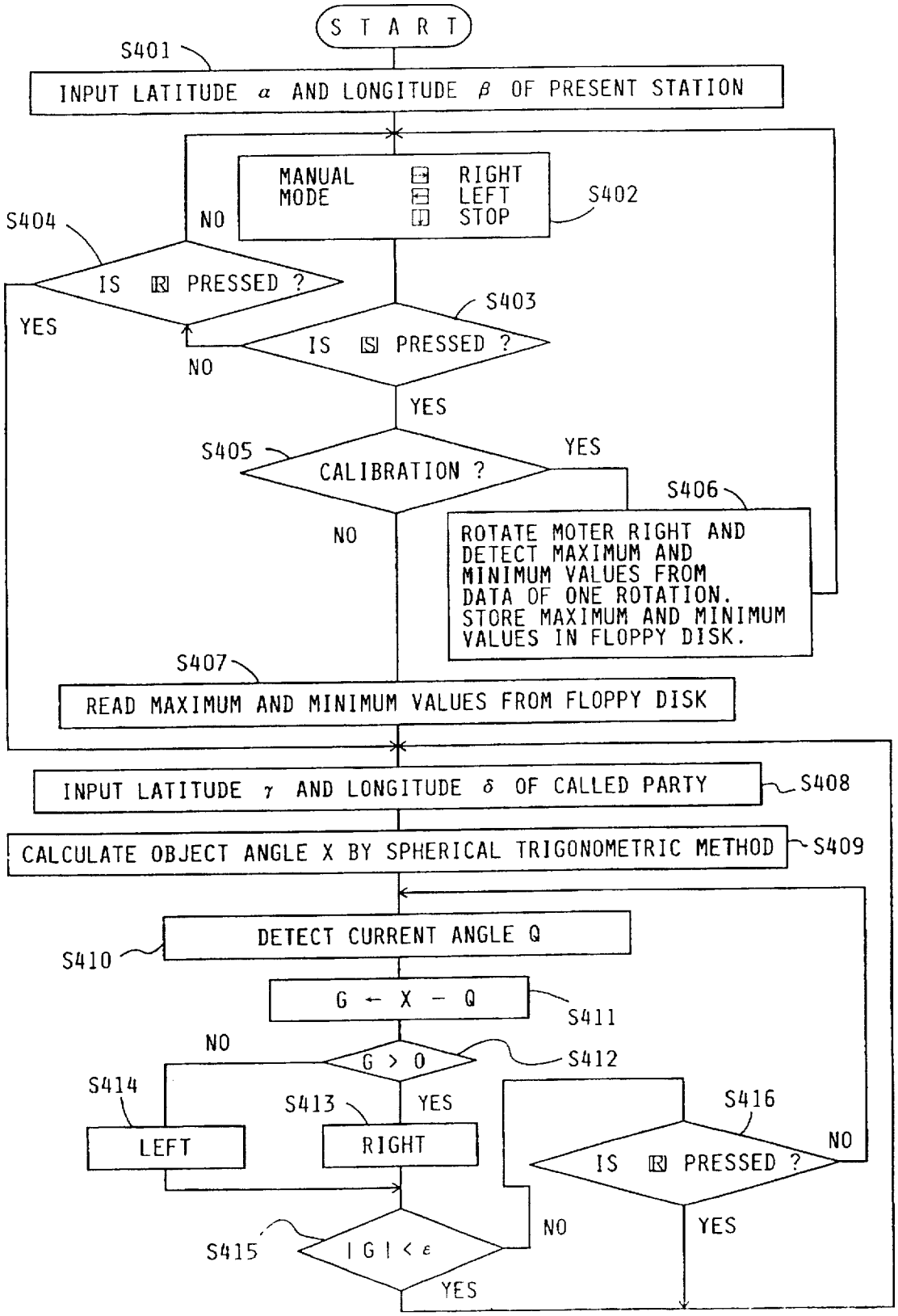
FIG. 11 is a flow chart illustrating the beam antenna control method according to the present invention.

One embodiment of the antenna controlling method using spherical trigonometric method will be described with reference to FIG. 11. First, the position (latitude α and longitude β) of the present station are input. For example, they must be input by the keyboard of a personal computer (S401). As the operations from the step S402 to S407 including setting on a manual mode and calibration are similar to those from the step S301 to S306 of the embodiment 3 shown in FIG. 9, their description will be omitted. When detection of the maximum and minimum values of the output of the magnetic sensor by calibration for rotating the antenna once is finished, the position (latitude γ, longitude δ) of the called party in which the antenna is to be turned is input by, for example, the keyboard (S408). Then, using spherical trigonometric method, the azimuthal angle X in which the antenna is to be turned is obtained. For example, this may be carried out by calculating the equations (3) and (5) (S409). The azimuthal angle Q which the antenna is currently facing is detected (S410). The operation of this step S410 will be carried out by the method and the device described in the embodiments 1 and 2.

Then, in order to compare the predetermined azimuthal angle X and the current antenna azimuthal angle Q, G=X−Q is calculated (S411). Whether the value of G is positive or negative is identified (S412). Herein, as the azimuthal angle indicates an angle when the antenna is rotated clockwise (right) with the North as a reference 0°, the motor, i.e., the antenna, is rotated right when G is positive (S413) while it is rotated left when G is not positive (S414). Whether the absolute value of G is within the set reference range or not is identified (S415), when it is larger than the reference value, the operation returns to the previous step after identifying pressing of ⌈R⌋ (S416). When ⌈R⌋ is pressed, the operation returns to the step S408 while it returns to the step S410 and the operations from the step S410 to S416 are repeated when ⌈R⌋ is not pressed until the absolute value of G comes within the reference range.

According to the method of this embodiment, the motor, or the antenna, is rotated, the directions thereof are successively detected during its rotation, a difference between the antenna direction at this time and the predetermined direction is calculated and the direction thereof is controlled so as to eliminated the difference. However, it is possible to set the motor, or the antenna, in a predetermined direction by one controlling based on the initially gained value of G.

Further, it is possible to control the right or left rotation of the motor, or the antenna, by changing the identification conditions of the step S412 so as to turn the antenna in the predetermined direction at a fast speed. Also, it is possible to provide the identification operation of the step S415 between the steps S411 and S412.

Figure 8:
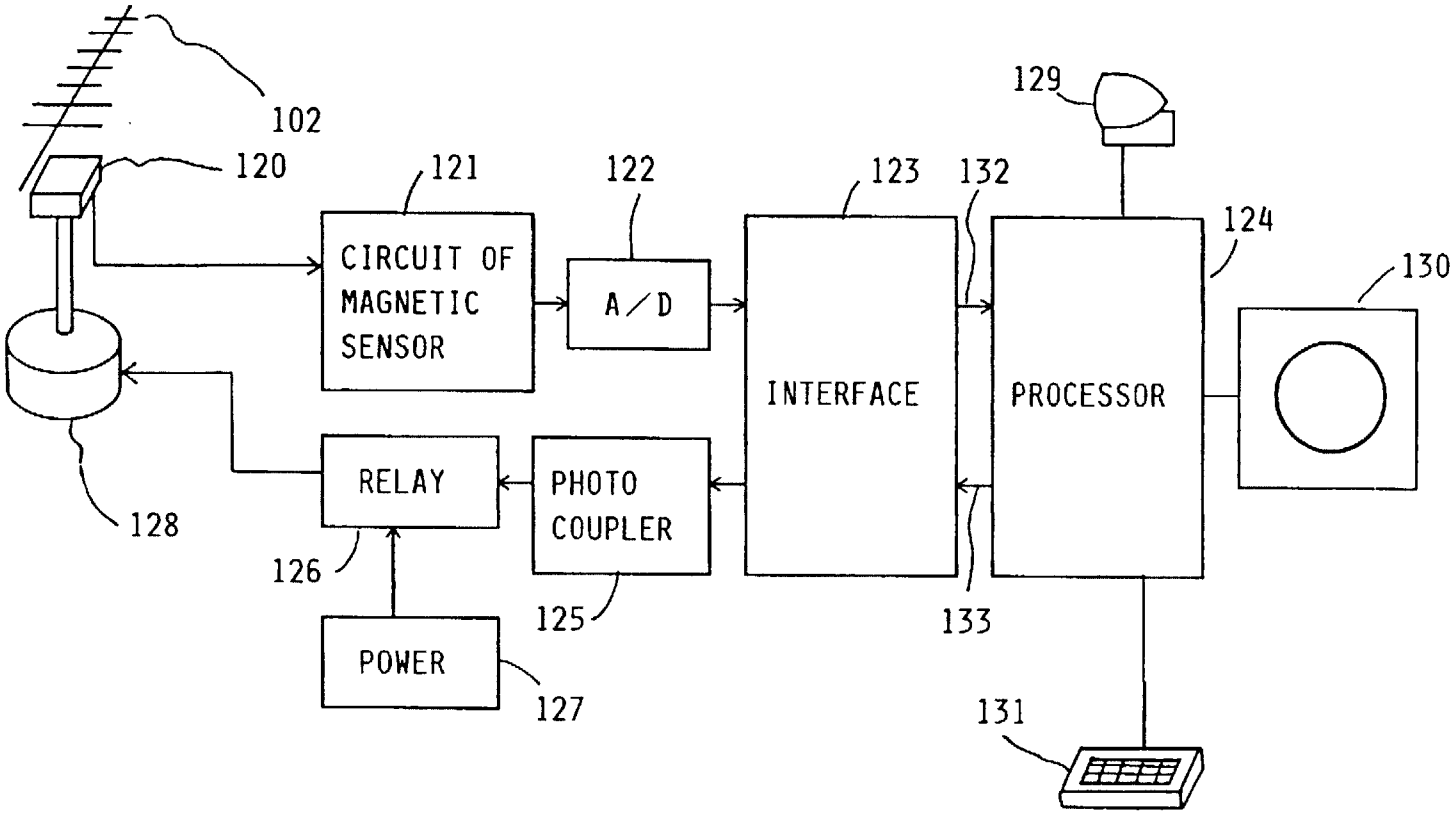
FIG. 8 is a block diagram showing the embodiment of the beam antenna device according to the present invention.

The construction of the antenna device using spherical trigonometric method is as shown in FIG. 8. The description of the operations similar to those in the embodiment 3 will be omitted or simplified. The outputs of the magnetic sensor 120 at the time of one rotation of the antenna 102 are successively converted into electric signals by the circuit of magnetic sensor 121 and input to the processor 124 via the A/D converter 122 and the interface 123. At the processor 124, the maximum and minimum values are detected out of the values output from the circuit of magnetic sensor 121 and they are stored in such storage devices 130 as a floppy disk, a hard disk, RAM or the like.

Then, using data on latitudes and longitudes of the present station and the called party input from the keyboard 131, the azimuthal angle X and the distance L are obtained based on spherical trigonometric method. For example, the equation (5) is calculated by the processor 124 and based on the result thereof the angle X and the distance L are calculated using the equation (3). Herein, the operations of the equations (3), (4) and (5) may be carried out by the software on a personal computer or by a hardware exclusively provided. At this embodiment, the former is used. Further, at the processor 124, the current beam direction of the antenna 102 is detected from the output value of the circuit of magnetic sensor 121 corresponding to that of the magnetic sensor 120. For this, as described in the embodiment 3, the device and the method shown in the embodiments 1 and 2 are used. The current azimuthal angle Q of the antenna thus obtained is stored in the other storage parts of the processor 124.

When the antenna is to be turned in the predetermined direction, at the processor 124 the input azimuthal angle X and the current antenna azimuthal angle Q are compared and a motor was controlled so as to eliminate the difference therebetween. As this operation is the same as in the embodiment 3, its description will be omitted.

Further, the present invention allows inputting of names instead of the latitudes and longitudes of the present station and the called party. In this case, names and corresponding latitudes and longitudes are placed in the database and the latitudes and the longitudes will be obtained by retrieving them in the database at the time of inputting the names. For example, as shown in FIG. 11, its latitude and longitude are inputted beforehand when the position of the present station is fixed (S401) and when the called party "ARAKI" is inputted at the step S408, the database is retrieved by the processor and its latitude and longitude is obtained. Then, based on these latitude and longitude, the direction for the antenna is decided. Also, when the present station is mounted on such moving bodies as a motor vehicle and the like, the present latitude and longitude thereof gained by a navigation device, etc., are inputted to the processor and the called party is inputted as "ARAKI" at the step S408. At this time, the database is retrieved by the processor and the latitude and longitude of "ARAKI" are obtained. In this way, as the necessity of remembering the latitude and longitude of each called party is eliminated, operability will be improved.

Further, based on the distance L between the present station and the called party, the elevation angle of the antenna may be decided. When the distance L is known, how many times discharged radio waves must be reflected on the ionization layer and the ground surface before reaching the called party is decided (least attenuation). Thus, the position of the ionization layer on which the radio wave is reflected may be determined, as well. That is, the elevation angle of the antenna will be determined. Furthermore, it is also possible to display the current and the predetermined directions of the antenna, the distance with the called party or the like on the display device 129 in FIG. 8. As described above, at the antenna direction measuring method and the direction controller according to the present invention, measuring and controlling of the antenna direction is allowed from the data based on one circuit of magnetic sensor, and thus the device may be simplified. Also, when a plurality of circuit of magnetic sensor are provided, as direction measuring with highly accurate detection is allowed, measuring and controlling accuracy will be improved.

Further, at the antenna direction controller according to the present invention, as the antenna direction is detected independent of the motor, it is not necessary to maintain a certain relation between the antenna direction and the motor for rotating it. Thus, a simple and inexpensive motor may be used and controlling of the motor rotation will be further simplified.

Further, at the antenna direction controller according to the present invention, as the azimuthal angle is decided using spherical trigonometric method, the antenna may be accurately turned in the direction of the called party even on a far place.

Furthermore, at the antenna direction controller according to the present invention, as it is so constructed as to gain the latitude and longitude of the called party only by inputting the name thereof or abbreviations of symbols, etc., operability will be improved.

Further, at the antenna direction controller for determining the azimuthal angle using spherical trigonometric method according to the present invention, as the elevation angle of the antenna is set based on the distance between the present station and the called party, better communications must be possible.

What is claimed is:

1. A method for measuring the direction of a beam antenna in an antenna system having at least one magnetic detection means for detecting at least one of the horizontal and vertical components of the geomagnetic field, comprising the steps of:

performing a calibration step by determining and storing maximum and minimum geomagnetic field calibration data values obtained from the magnetic detection means while rotating the beam antenna;

determining one or two possible direction candidates corresponding to output data from the at least one magnetic detection means in accordance with the maximum and minimum geomagnetic field calibration data values; and determining the direction of the beam antenna from two direction candidates by specifying one of the candidates depending upon whether a direction of rotation of the beam antenna is to the right or left, and determining the direction of the beam antenna from one direction candidate when the output data from the at least one magnetic detection means corresponds to the minimum or maximum geomagnetic field calibration data values.

2. A beam antenna direction measuring apparatus comprising: magnetic detection means for detecting at least one of the horizontal and vertical components of the geomagnetic field; a memory for storing maximum and minimum geomagnetic field calibration data values from the magnetic detection means obtained during a pre-measurement calibration process in which the beam antenna is rotated; operational means for calculating the direction of the beam antenna in accordance with output data from the magnetic detection means and the maximum and minimum geomagnetic field calibration data values; rotation identifying means for identifying whether rotation of the beam antenna is to the right or the left; and direction identifying means for determining the direction of the beam antenna according to the output of the rotation identifying means and the most recent output data of the magnetic detection means.

3. A method for measuring a direction of a beam antenna in an antenna system having a plurality of magnetic detection means attached to the beam antenna for detecting the horizontal and vertical components of the geomagnetic field, comprising the steps of:

performing a calibration step by determining and storing respective maximum and minimum geomagnetic field calibration data values obtained from the respective magnetic detection means while rotating the antenna;

specifying output data from the magnetic detection means as current output data;

determining one or two possible direction candidates corresponding to the current output data in accordance with the maximum and minimum geomagnetic field calibration data values; and determining the direction of the beam antenna from the two direction candidates by specifying one of the candidates depending upon whether a direction of rotation of the beam antenna is to the right or the left, and determining the direction of the beam antenna from one direction candidate when the output data from the at least one magnetic detection means corresponds to the minimum or maximum geomagnetic field calibration data values.

4. A beam antenna direction measuring apparatus according to claim 2; wherein the magnetic detection means comprises a plurality of magnetic detection means attached to the beam antenna; and further comprising selecting means for selecting one of the magnetic detection means which has the largest maximum or the smallest minimum output values out of the respective maximum and minimum values of the plurality of magnetic detection means and for supplying the output data of the selected magnetic detection means to the operational means to maximize the sensitivity of the beam antenna direction measuring apparatus.

5. A beam antenna direction measuring apparatus according to claim 2; wherein the magnetic detection means comprises a plurality of magnetic detection means; and further comprising output value selecting means for identifying one of the magnetic detection means which has output data that has the largest difference from the maximum or the minimum values thereof respectively and for supplying the output data from the selected magnetic detection means to the operational means to maximize the sensitivity of the beam antenna direction measuring apparatus.

6. A beam antenna direction control method in an antenna system having at least one magnetic detection means for detecting at least one of the horizontal and vertical components of the geomagnetic field, comprising the steps of:

performing a calibration step by determining and storing maximum and minimum geomagnetic field calibration data values obtained from the magnetic detection means while rotating the beam antenna;

finding one or two possible direction candidates corresponding to output data from the at least one magnetic detection means in accordance with the maximum and minimum geomagnetic field calibration data values;

determining the current direction of the beam antenna by specifying one of the candidates depending upon whether a direction of rotation of the beam antenna is to the right or the left;

detecting a difference between the current antenna direction and a desired direction; and rotating the antenna so as to reduce the difference.

7. A beam antenna direction control method for directing an antenna toward a called party in an antenna system having at least one magnetic detection means for detecting at least one of the horizontal and vertical components of the geomagnetic field, comprising the steps of:

performing a calibration step by storing maximum and minimum geomagnetic field calibration data values obtained from the magnetic detection means while rotating the beam antenna;

finding one or two possible direction candidates corresponding to output data from the at least one magnetic detection means in accordance with the maximum and minimum geomagnetic field calibration data values;

determining the current direction of the beam antenna from two direction candidates by specifying one of the candidates depending on whether a direction of rotation of the beam antenna is to the right or the left, and determining the direction of the beam antenna from one direction candidate when the output data from the at least one magnetic detecting means corresponds to the minimum or maximum geomagnetic field calibration data values;

determining the desired direction of antenna from data representing the location of the antenna and the location of the called party;

detecting a difference between the current antenna direction and the desired direction; and rotating the antenna so as to reduce the difference.

8. A beam antenna direction control method according to claim 7; wherein the data representing the locations of the antenna p and the called party are expressed in latitudes and longitudes, and the desired direction is determined by a spherical trigonometric method in accordance with the latitudes and longitudes.

9. A beam antenna direction control method according to claims 7; wherein the location of the called party is represented by a name or other symbol; and further comprising the step of referring a database to determine a latitude and longitude corresponding to the name or other symbol of the called party.

10. A beam antenna direction control method according to claim 8; wherein the location of the called party is represented by a name or other symbol; and further comprising the step of referring to a database to determine a latitude and longitude corresponding to the name or other symbol of the called party.

11. A method for measuring the direction of a beam antenna according to claim 1; further comprising the step of determining whether the direction of rotation of the beam antenna is to the right or the left by comparing successive directions of the beam antenna based on output values of the magnetic detecting means, and determining whether the beam antenna is moving to the right or the left.

12. A method for measuring the direction of a beam antenna according to claim 1; wherein the step of determining the direction of the beam antenna comprises the step of determining an angle of azimuth of the beam antenna in accordance with the formula $$\sin^{-1}\{[2L-(Lmax+Lmin)]/(Lmax-Lmin)\}$$

wherein Lmax is the maximum geomagnetic field calibration data value, Lmin is the minimum geomagnetic field calibration data value, and L is the output data of the magnetic detecting means.

13. A beam antenna direction measuring apparatus according to claim 2; wherein the magnetic detection means comprises at least one magnetic field sensor having a pickup coil attached to the beam antenna, a winding direction of the pickup coil being arranged at a predetermined angle with respect to the direction in which an elongated member of the beam antenna extends, such that the pickup coil detects the geomagnetic field in accordance with the direction of the elongated member of the beam antenna and outputs a sinusoidal signal in response to rotation of the elongated member of the beam antenna.

14. A beam antenna direction measuring apparatus according to claim 13; wherein the predetermined angle is 90 degrees.

* * * * *